US005276377A

United States Patent [19]

Van Nes et al.

[11] Patent Number: 5,276,377

[45] Date of Patent: Jan. 4, 1994

[54] CATHODE RAY TUBE HAVING A CURVED DISPLAY WINDOW AND A COLOUR DISPLAY DEVICE

[75] Inventors: Johannes C. A. Van Nes; Johannes Penninga; Marcus T. M. Crooymans, all of Eindhoven, Netherlands

[73] Assignee: U.S. Philips Corporation, New York, N.Y.

[21] Appl. No.: 641,376

[22] Filed: Jan. 15, 1991

[30] Foreign Application Priority Data

Jan. 17, 1990 [NL] Netherlands ..... 9000111

[51] Int. Cl.[5] ..... H01J 29/10

[52] U.S. Cl. ..... 313/461; 313/477 R

[58] Field of Search ..... 313/402, 408, 461, 477; 220/2.1

[56] References Cited

U.S. PATENT DOCUMENTS 4,570,101 2/1986 Campbell ..... 313/461

4,777,401 10/1988 Hosokoshi et al. ..... 313/477 R

*Primary Examiner*—Donald J. Yusko

*Assistant Examiner*—Ashok Patel

*Attorney, Agent, or Firm*—Paul R. Miller

[57] ABSTRACT

A color cathode ray tube of the type having a color selection electrode arranged in front of the display screen, is characterized in that the inner surface of the screen exhibits a deviation from an arc shape along the long X axis such that, in operation, the effect of doming is reduced. Preferably, the deviation decreases as the distance to the long axis increases. In an embodiment, the inner surface also exhibits a deviation from an arc shape along the short y-axis.

35 Claims, 8 Drawing Sheets

$f^1(X) = -5.44 * (X^4 - X^2) * (1 - 2 * Y^2 + Y^4)$ $f^1(X) = 5.44 * (X^4 - X^2) * (Y^2 - 1)$

CATHODE RAY TUBE HAVING A CURVED DISPLAY WINDOW AND A COLOUR DISPLAY DEVICE

BACKGROUND OF THE INVENTION

The invention relates to a cathode ray tube comprising an electron gun, a display screen provided on an inner surface of an at least substantially rectangular curved display window and a colour selection electrode arranged in front of the display screen.

The invention also relates to a color display device comprising a cathode ray tube.

Such cathode ray tubes are known. In operation, the electrons of an electron beam emitted by the electron gun impinge on the color selection electrode, thereby heating it. Approximately 80% of all electrons are captured by the color selection electrode. The heating of the color selection electrode causes the electrode to expand. As a result the apertures in the color selection electrode are displaced relative to the display screen. This phenomenon is called "doming". One type of doming is the so-called local doming. Local doming occurs as a result of differences in the intensity of the image displayed. As a result, certain parts of the color selection electrode are heated more than others, thereby causing the color selection electrode to bulge locally, which brings about color errors.

OBJECTS AND SUMMARY OF THE INVENTION

One of the objects of the invention is to reduce the effect of doming, in particular local doming, of the color selection electrode.

The cathode ray tube according to the invention is characterized in that the d stance z between a plane tangential to the display screen, at the center of the display screen, and a plane extending parallel thereto, through a point on the long axis of the screen can be approximately represented by:

$$Z=R_1-(R_1^2-x^2)^{\frac{1}{2}}+f(x)$$

where $R_1$ is a radius of a perfect circle going through the point $z=0$, $x=0$, x is the distance between the center of the display screen and the point on the long axis and f(x) is an approximately symmetrical function in x, which function is 0 for $x=0$ and for the end of the long axis, and which is negative at least substantially everywhere between these points, and which has an extreme for $0.5<x<0.9$ L, where L is the length of the long axis.

The screen exhibits a deviation from an arc shape along the long axis, which deviation reduces the effect of doming, in particular local doming, of the color selection electrode. It is noted that the shape of the color selection electrode a approximately corresponds to the shape of the screen, which in turn corresponds to the inner surface of the display window. By superposing an outwardly directed deviation f(x), hereinafter also referred to as a "bulge," on the arc shape of the long axis, represented by the function $R_1-(R_1^2-x^2)^{\frac{1}{2}}$, the radius of curvature in the x-direction of the inner surface and the radius of curvature in the x-direction of the color selection electrode, whose shape is adapted to the inner surface, decrease along the long axis as the value of x increases. As a result the effect of local doming is reduced. Preferably, f(x) has an extreme for $0.65\ L<x<0.80\ L$.

In a further embodiment the distance z between a plane tangential to the display screen at the center of the display screen and a plane parallel thereto, through a point P on a line parallel to the long axis can be approximately represented by:

$$z=z_0+R'_1{}'-(R'^2_1{}_i-x^2)^{\frac{1}{2}}+f'(x)$$

where $z_O$ is a constant for the given line, x is the distance between the point where the given line intersects the short axis of the screen and the point P, and f'(x) is an approximately symmetrical function in x, which function is 0 for $x=0$ and $x=L$, which is negative at least substantially everywhere between these points, and which has an extreme for $0.5\ L<x<0.9\ L$, with the value of the extreme decreasing according as the value of y increases.

In the above-mentioned embodiment, along lines perpendicular to the short axis and parallel to the long axis, the deviation (i.e., the "bulge") is a function of the distance to the long axis. The deviation from an arc shape in the inner surface varies over the inner surface. As a result, a further reduction of the effect of doming is possible. The deviation decreases in a direction transversely to the long axis. In yet another embodiment, viewed from the long axis, the deviation, i.e. the value of the extreme of f(x), at the extreme edges is less than 1/5th of the deviation on the long axis, Preferably, the deviation at the extreme edges if approximately 0.

Preferably, the maximum deviation on the long axis is less than 2% of the length of the long axis. By virtue of the bulge the effect of local doming in the x-direction is reduced. However, still other disturbing image errors may occur, for example, so-called raster errors. Raster errors occur when the maximum deviation is more than 2% of the length of the long axis.

Preferably the maximum deviation on the long axis is more than 0.05% of the length of the long axis. In the case of deviations smaller than 0.05%, the positive effect on local doming is small.

In a further embodiment, the distance z between a plane tangential to the display screen at the center of the display screen, and a plane parallel thereto, through a point P' on a line parallel to the short axis can be approximately represented by:

$$z=z'_0+R''_1{}''-(R''^2_1{}''-y^2)^{\frac{1}{2}}+f''(y)$$

where $z'_0$ is a constant for the given line, y is the distance between the point where the given line intersects the long axis and the point P', and f''(y) is an approximately symmetrical function in y, which function is 0 for $y=0$ and $y=L_1$, which is negative at least substantially everywhere between these points, and which has an extreme for $0.5\ L_1<y<0.9\ L_1$, where $L_1$ is the length of the short axis and the value of the extreme is dependent on the distance x between the line and the short axis and increases as the value of x increases. Thus a "bulge" along the short axis is defined. This enables a further improvement of local doming. Preferably, the maximum value of the extreme of f''(y) is smaller than 2% of the length of the short axis. A larger maximum value may lead to disturbing raster errors.

The invention is of great importance to cathode ray tubes having a curvature of the display window along the short axis which is larger, i.e. the radius of curvature $R_y$ is smaller than the radius of curvature $R_x$ along the long axis. In an embodiment, the ratio between the radius of the curvature along the long axis $R_x$ and the radius of curvature along the short axis $R_y(R_y:R_x)$ is less than 3:4, for example, approximately 9:16.4.

BRIEF DESCRIPTION OF THE DRAWING

By way of example, a few embodiments of the cathode ray tube and the color display device according to the invention will be described and explained in more detail with reference to the accompanying drawing, in which.

The Figures are diagrammatic representations and are not drawn to scale, corresponding parts in the various embodiments generally bearing the same reference numerals.

DESCRIPTION OF THE PREFERRED EMBODIMENTS

Figure 1:
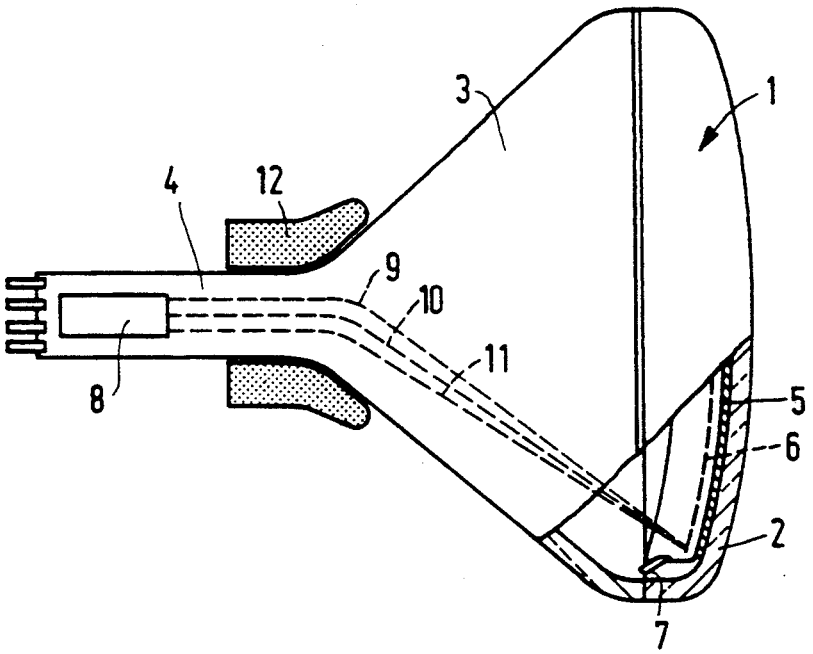
FIG. 1 is a sectional view of a color display device according to the invention.

FIG. 1 is a sectional view of a color display device according to the invention. The color display device comprises a cathode ray tube 1 having an envelope with a substantially rectangular curved display window 2. The envelope further comprises a cone 3 and a neck 4. A pattern of phosphors 5 luminescing in the colors blue, red and green is provided on inner surface of the display window 2. A substantially rectangular color selection electrode 6 having a large number of apertures is suspended at a short distance from the display window 2 by means of suspension means 7 near the corners of the color selection electrode. An electron gun 8 for generating three electron beams 9, 10 and 11 is arranged in the neck 4 of the cathode ray tube 1. The beams are deflected by a deflection system 12 and intersect each other substantially at the location of the color selection electrode 6, after which each electron beam impinges on one of the three phosphors provided on the screen.

Figure 2:
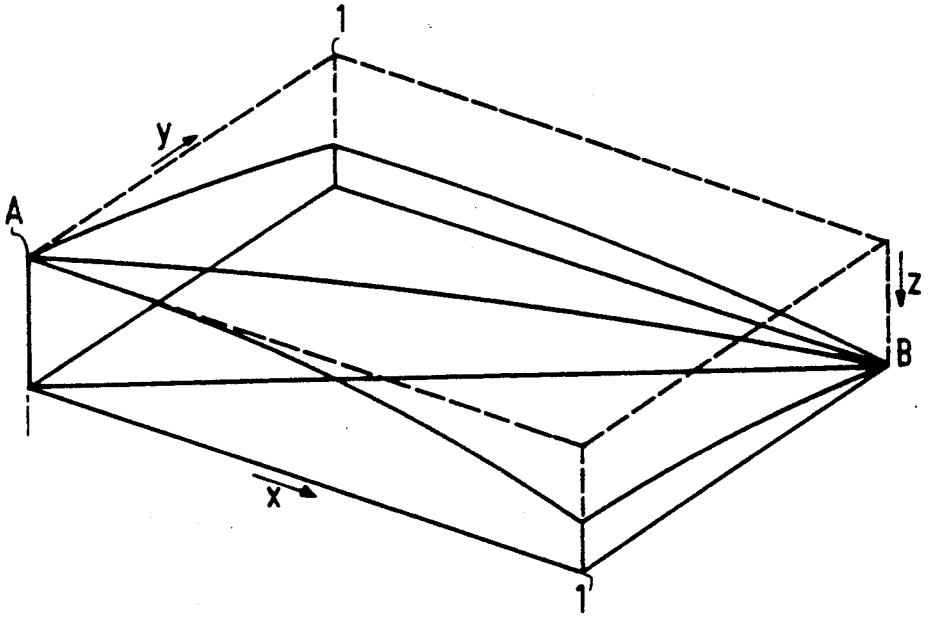
FIG. 2 is a partly perspective top view of a quadrant of the inner surface of a display window suitable for a cathode ray tube according to the invention.
Figure 11:
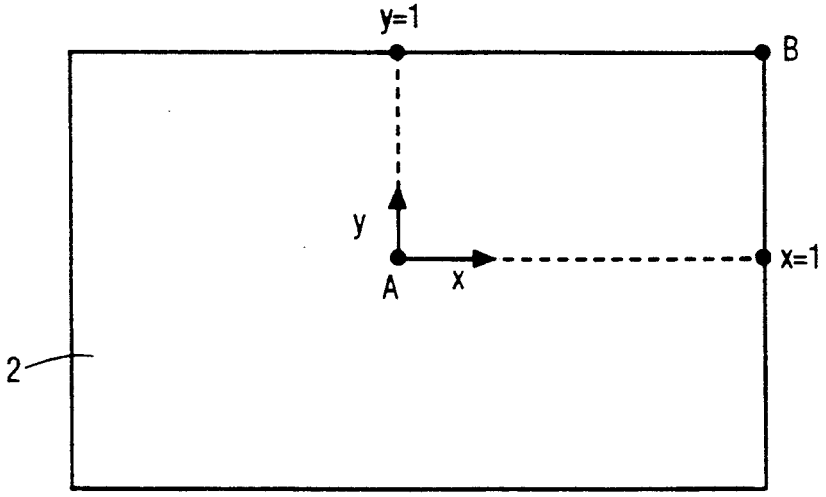
FIG. 11 is a front view of the display screen shown in FIG. 1 to show a "quadrant" view, as seen in FIG. 2.

FIG. 2 is a partly perspective top view of a quadrant of the inner surface of a display window planar front view in FIG. 11, suitable for use in a cathode ray tube according to the invention. Point A denotes the center of the inner surface of the display window. The long axis is referred to as the x-axis, the short axis is referred to as the y-axis. For simplicity, the ends of the x-axis and the y-axis have been given values for x and y, respectively, of 1. In fact, the length of the long axis is, for example, 332 mm and the length of the short axis is, for example, 188 mm, which corresponds to a length-width ratio of approximately 16:9. Point B denotes a corner of the inner surface of the display window. The direction perpendicular to the x-axis and the y-axis is the z-direction.

Figure 3:
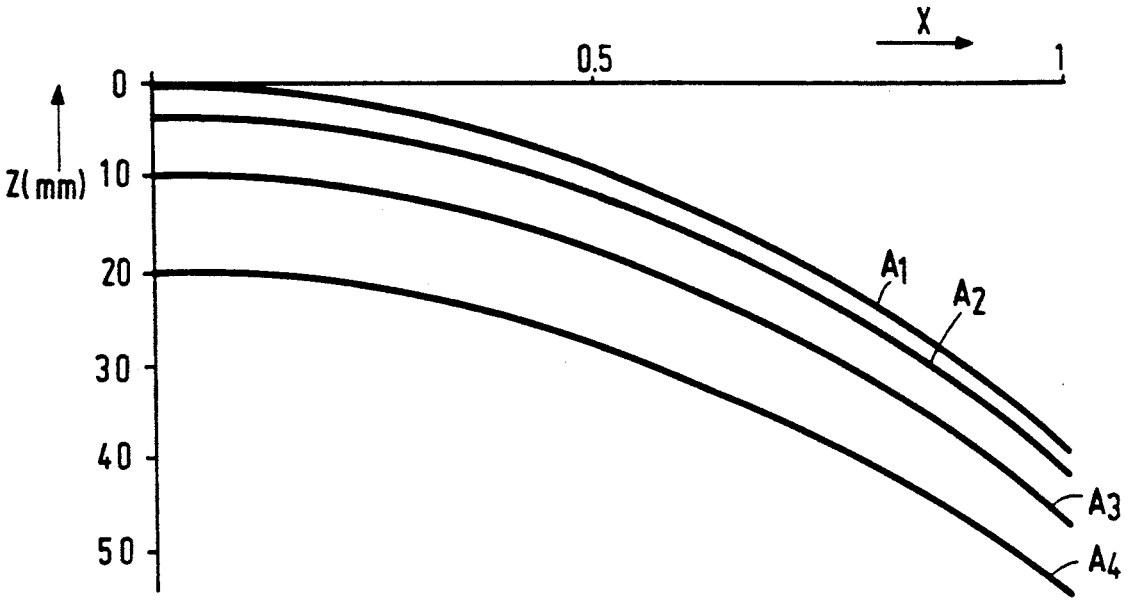
FIG. 3 is a graphic representation of the distance Z for the long axis X and for a number of lines located at a distance from the long axis.

FIG. 3 shows the z-value for four lines. The x-value is plotted on the horizontal axis, the z-value in mm is plotted on the vertical axis. Line $A_1$ is the intersecting line of the inner surface of the display window with the plane $y=0$. Line $A_2$ is the intersecting line of the inner surface with the plane $y=0.3$. Line $A_3$ is the intersecting line of the inner surface with the plane $y=0.7$. Finally, line $A_4$ is the intersecting line of the inner surface with the plane $y=1.0$. In this case, z is defined as having a positive value. When z is plotted as a function of x, there is a deviation from an arc-shaped relation between z and x. An arc-shaped relation is to be understood to mean that z can be expressed by $z=z_0+R'_1{}'-(R'_1{}'^2-x^2)^{\frac{1}{2}}$.

Figure 4A:
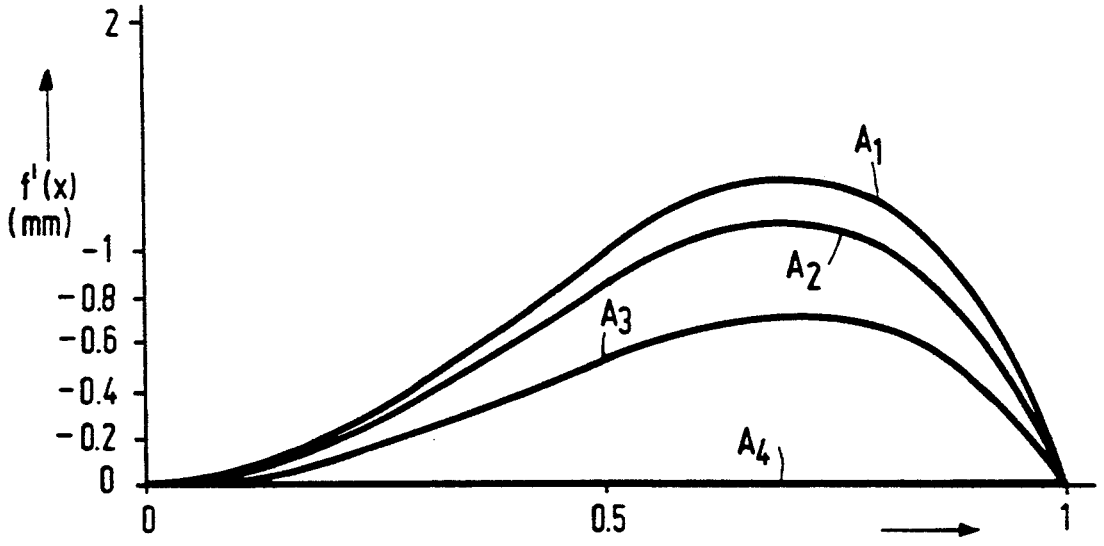
FIG. 4*a* shows graphically the deviations from an arc shape for the lines shown in FIG. 3.

FIG. 4*a* shows the deviation $f'(x)$ from an arc shape for the lines $A_1$ up to and including $A_4$ through the beginning and the end of the lines. In this Figure, the line $f'(x)=0$ corresponds to perfectly arc-shaped lines (spherical sections) through the beginning and the end of the lines $A_1$ up to and including $A_4$. The deviation $fl(x)$ (in mm) of the lines $A_1$ up to and including $A_4$ from the arc shape is plotted on the vertical axis. This deviation is negative. That is, viewed from the cathode ray tube neck, the deviation is outwardly directed. The deviation is 0 for $x=0$ and $x=1$. This can be attributed to the fact that the arc-shaped lines are selected such that they pass through the beginning and the end of the lines $A_i$. The deviations exhibit an extreme for x approximately equal to 0.7. The value of the extreme decreases as the lines are further removed from the x-axis, i.e., as the value of y increases. Along the x-axis (the long axis) z is represented by $z=R_1-(R_1-^2-x^2)^{\frac{1}{2}}+f(x)$, $R_1$ and $f(x)$ being of opposite sing; for the entire system of lines $A_1$ up to and including $A_4$, z as a function of x can be expressed by $z=z_0+R'_1{}'-(R'_1{}'^2-x^2)^{\frac{1}{2}}+f'(x)$, where $z_0$, $R'_1{}'$ and $f'(x)$ may be, and in this example are, dependent on y.

Figure 4B:
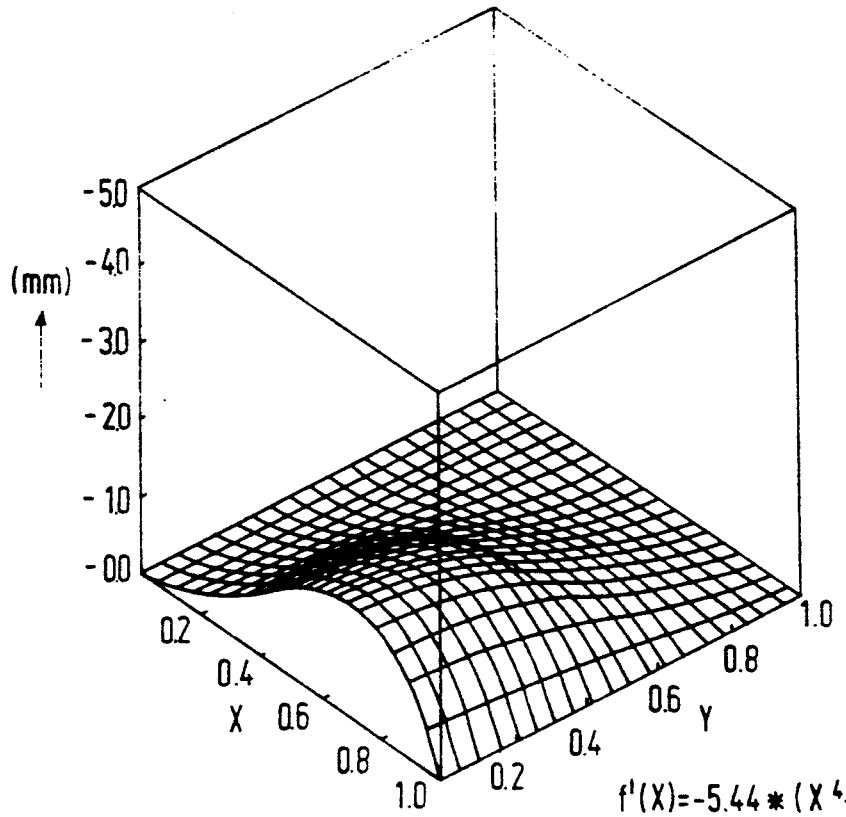
FIGS. 4*b* and 4*c* are perspective elevational views of two examples of "bulges" in the inner surface of the display window.
Figure 4C:
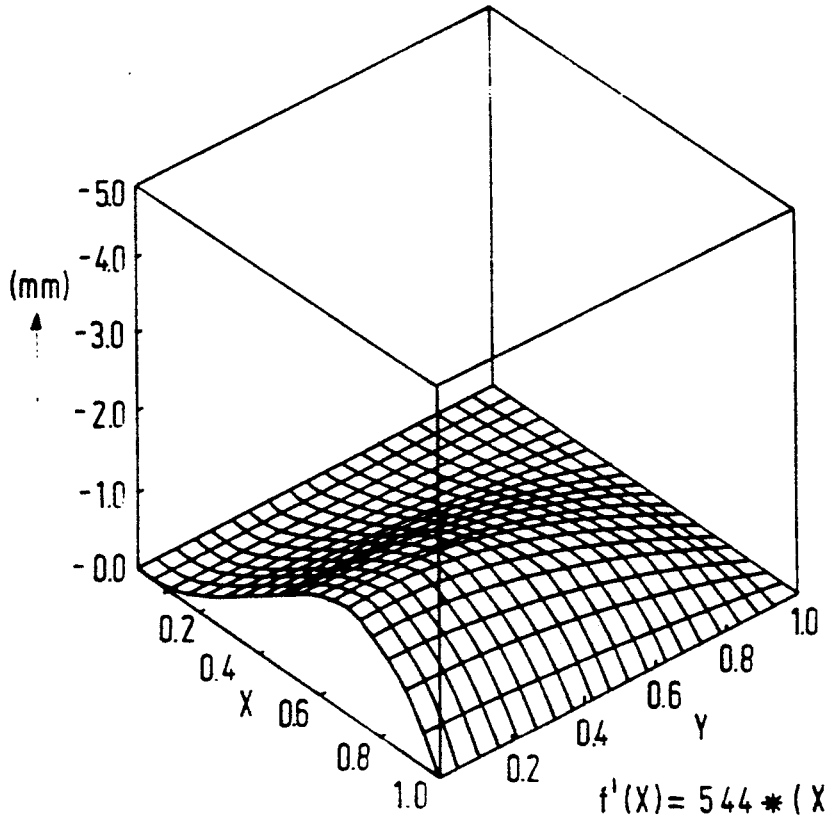

FIGS. 4*b* and 4*c* are the analytical shapes of examples of two "bulges" in the inner surface of the display window.

Figure 4D:
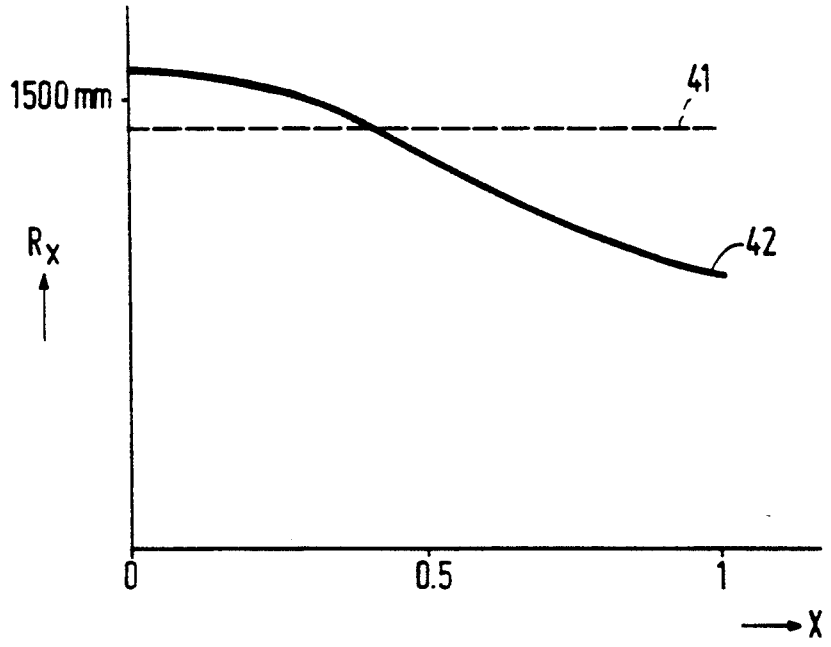
FIG. 4*d* is a graphic representation of the radius of curvature $R_x$ along the long X axis.
Figure 10:
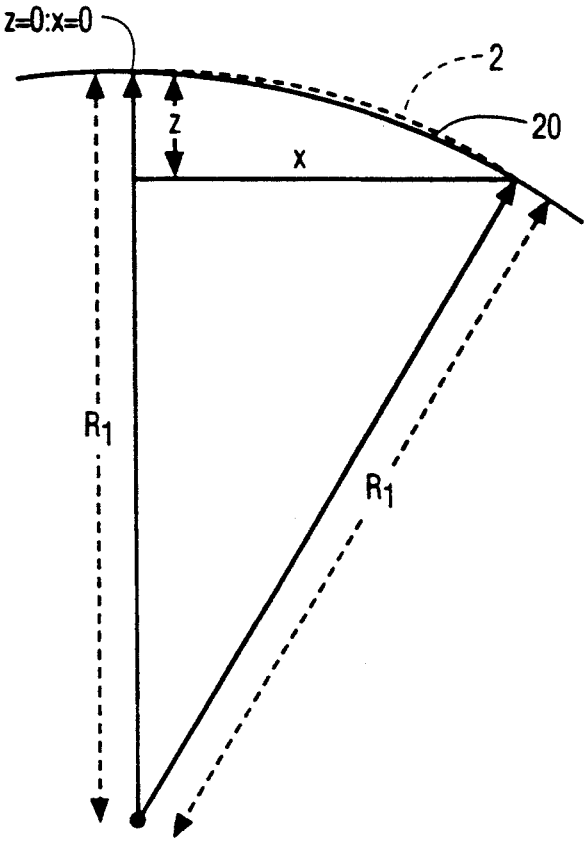
FIG. 10 is a representation of a portion of a perfect circle having a radius $R_1$.

FIG. 4*d* is a graphic representation of the radius of curvature in the x-direction ($R_x$) along the longitudinal axis as a function of the x-value. Line 41 shows a perfect arc shape, i.e. a constant $R_x$; line 42 shows $R_x$, corresponding to radius $R_1$ of a perfect circle, such as seen in FIG. 10 for a color display device according to the invention.

Figure 5:
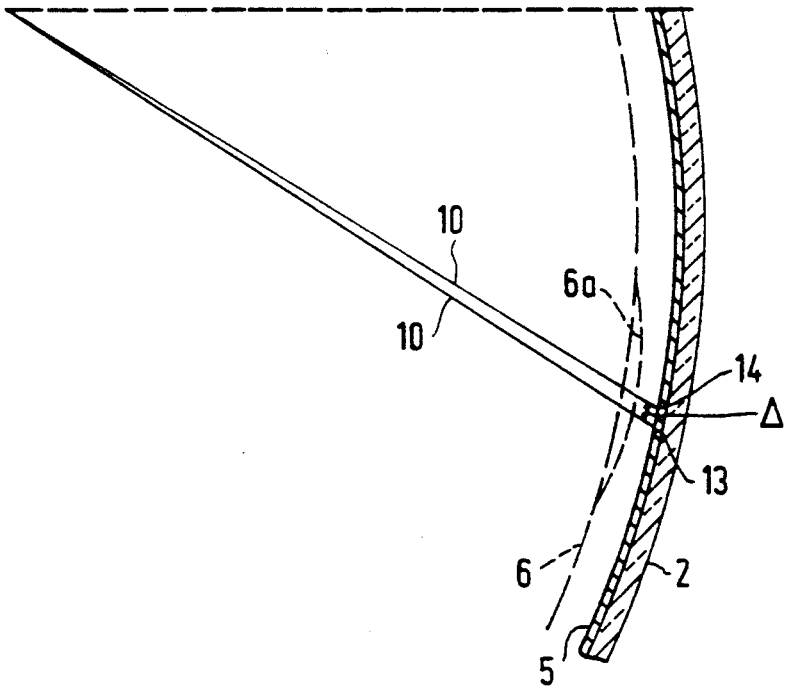
FIG. 5 is a sectional view of part of a cathode ray tube, by means of which several aspects of local doming are explained.

FIG. 5 is a sectional view of a part of a color display tube, which illustrates the effect of the local heating of the color selection electrode 6, which effect is termed "local doming". In the "cold state", the electron beam 10 is incident on the display screen 5 on the inside of the display window 2 at point 13. A local heating of the color selection electrode 6, which may occur, for example, when the image displayed exhibits large differences in intensity, i.e. dark and light areas, causes the color selection electrode to bulge locally, as shown by bulge 6a. As a result the apertures through which the electron beam 10 passes are displaced relative to the display screen 5. The electron beam 10 then impinges on the display screen 5 at point 14. The distance between the points 13 and 14 is the beam landing displacement Δ.

Figure 6A:
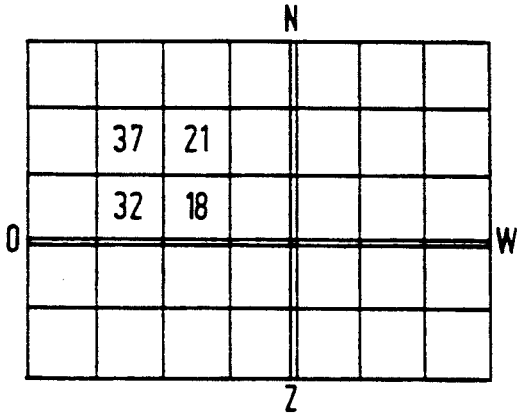
FIGS. 6*a* and 6*b* graphically present a few values of beam displacements caused by local doming.
Figure 6B:
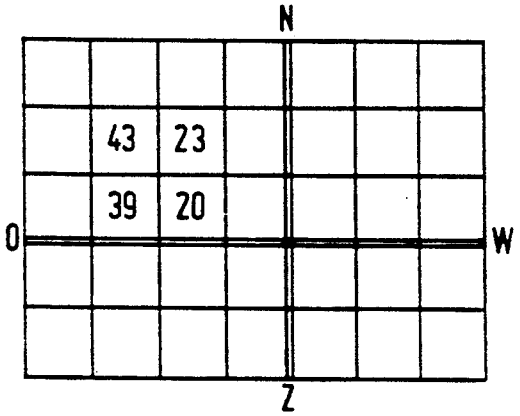

FIGS. 6a, 6b give the to beam landing displacement values due to local doming values for four positions on the display screen of a 86 FS color display tube having a length: width ratio of 16:9, the values being measured for a known color display device (FIG. 6b) and for a color display device according to the invention (FIG. 6a). The color selection electrode in both cases was manufactured from an iron-nickel alloy having a low coefficient of thermal expansion. In these tests, areas measuring 10 cm by 10 cm were exposed to an electron beam having a power of 33 Watts. A marked reduction, namely 10 to 20%, in beam displacements caused by local doming is obtained.

Figure 6C:
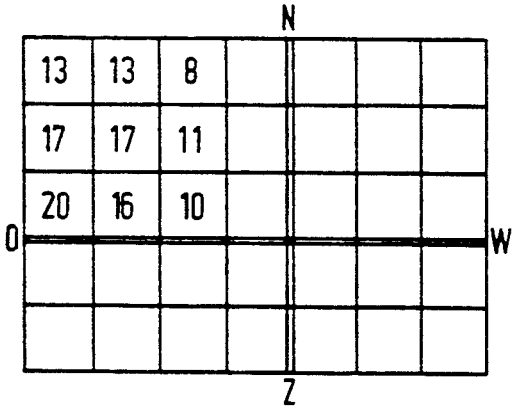
FIGS. 6*c* and 6*d* graphically present a few values of beam displacements caused by overall doming.
Figure 6D:
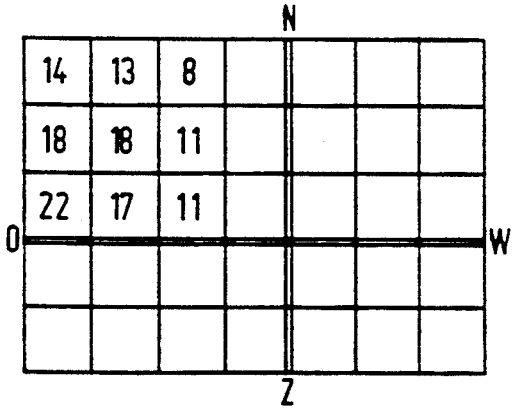

FIGS. 6c and 6d give the overall doming for the same tubes. "Overall doming" is the effect which occurs when the color selection electrode heats up integrally. FIG. 6d gives the landing displacement as a result of overall doming for a known display device and FIG. 6c for a display device according to the invention. Landing displacements due to overall doming also has been reduced by a few percent.

In the case of color display devices comprising an iron color selection electrode instead of an iron-nickel alloy electrode, it also appears that when beam displacements caused by local doming are reduced in a color display device according to the invention. A measurement carried out on a known color display device yielded a beam displacement of 150 μm as compared to a displacement of 120 μm for a color display device according to the invention.

Figure 7:
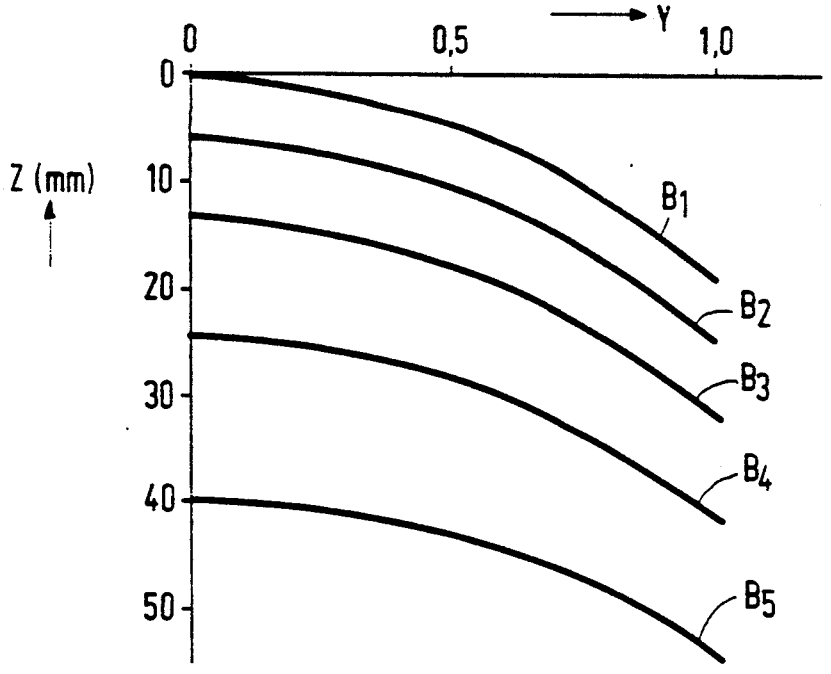
FIG. 7 shows graphically the distance in the z-direction between the center of the inner surface of the display window and points on the inner surface of the display window along lines parallel to the short or y-axis.

FIG. 7 shows the distance in the z-direction between the center of the inner surface of the display window and points on the inner surface of the display window along five lines which extend parallel to the short axis of y-axis. The y-value is plotted on the horizontal axis; the z-value in mm is plotted on the vertical axis. Line $B_1$ is the intersecting line of the inner surface with the plane $x=0$. Line $B_2$ is the intersecting line of the inner surface with the plane $x=0.3$. Line $B_3$ is the intersecting line of the inner surface with the plane $x=0.6$. Line $B_4$ is the intersecting line of the inner surface with the plane $x=0.8$. Finally, line $B_5$ is the intersecting line of the inner surface with the plane $x=1.0$. In this case, z has been defined as a positive value. When z is plotted as a function of y, there is a marked deviation from an arc-shaped relation between z and y. An arc-shaped relation to be understood to mean that z can be expressed by $z=z_{0'}+R''_1''-(R''_1''^2-x^2)^{\frac{1}{2}}$. In this example, the radius of curvature in the y-direction is approximately 900 mm and, hence, smaller than the radium of curvature $R_x$ along the long axis which is approximately 1400 mm (see FIG. 4D).

Figure 8:
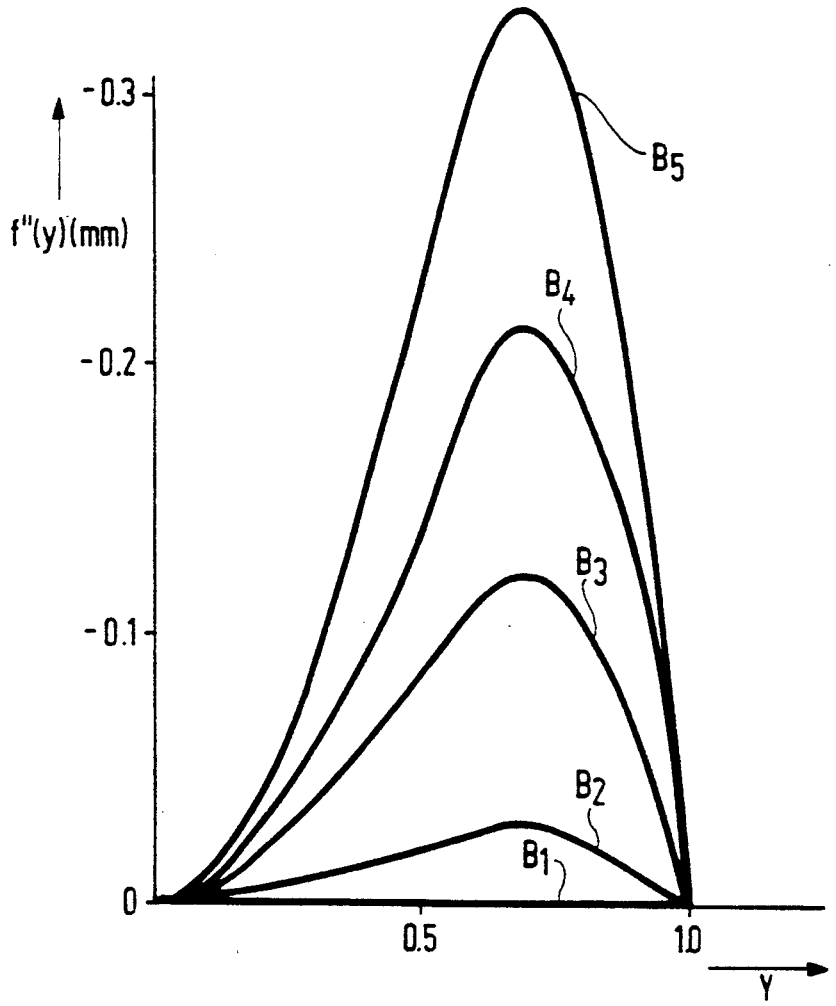
FIG. 8 shows graphically the deviations from an arc shape for the lines shown in FIG. 7.

FIG. 8 shows the deviation f''(y) from an arc shape through the beginning and the end of the lines for the lines $B_1$ up to and including $B_5$. In this Figure, the line $z=0$ corresponds to perfectly arc-shaped lines (spherical sections) through the beginning and the end of the lines $B_1$ up to and including $B_5$. The deviation f''(y) from the arc shape of the lines $B_1$ up to and including $B_5$ (in mm) is plotted on the vertical axis. The deviation is negative. That is, viewed from the cathode ray tube neck, the deviation is directed outwards. The deviation is 0 for $y=0$ and $y-1$. This is caused by the fact that the arc shapes are selected such that they pass through the beginning and the end of the line $B_i$. The deviations exhibit an extreme for a value of y approximately equal to 0.7. The value of the extreme increases as the lines are further removed from the y-axis. Along the y-axis (the short axis) z is expressed by $z=R''_1-(R''_1''^2-y^2)^{\frac{1}{2}}$; for the entire system of lines $B_1$ up to and including $B_5$, z as a function of y can be expressed by $z=z_o'+R'_1''^2-y^2)^{\frac{1}{2}}+f''(y)$, where $Z_0'$, $R_1''$ and f''(y) may be, and in this example are, dependent on x, and where the absolute value of f''(y) increases as the x-value increases.

Figure 9A:
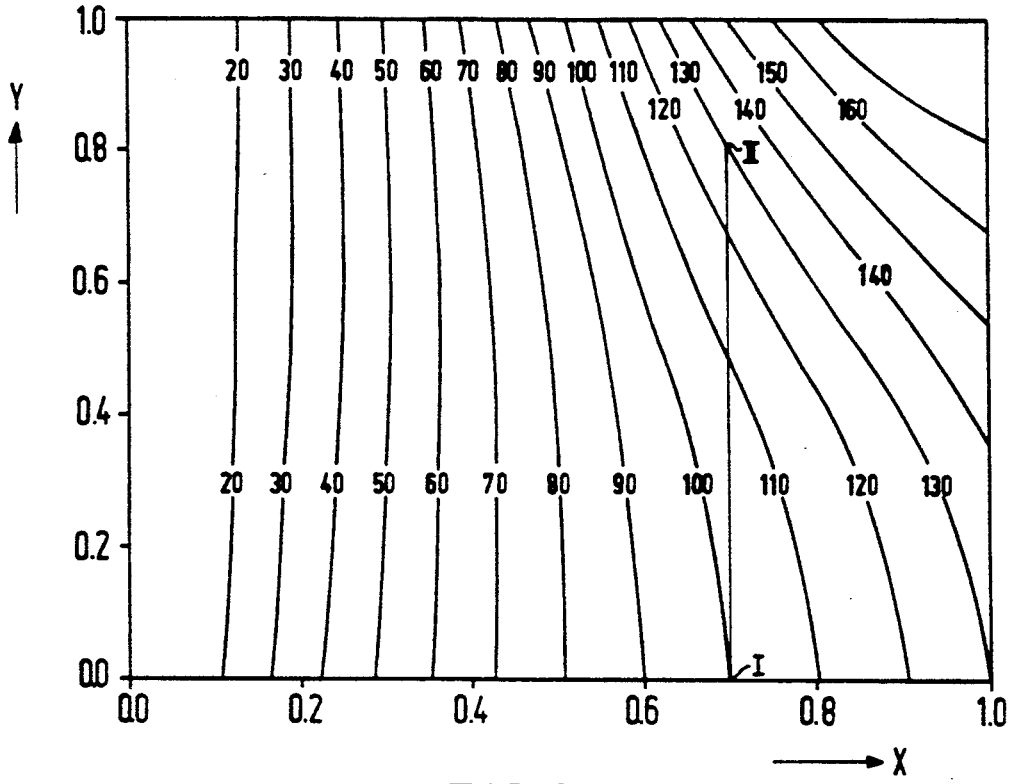
FIGS. 9*a* and 9*b* graphically illustrate of the two-dimensional effect of the deviations from a perfect arc shape shown in FIG. 7 and 8.
Figure 9B:
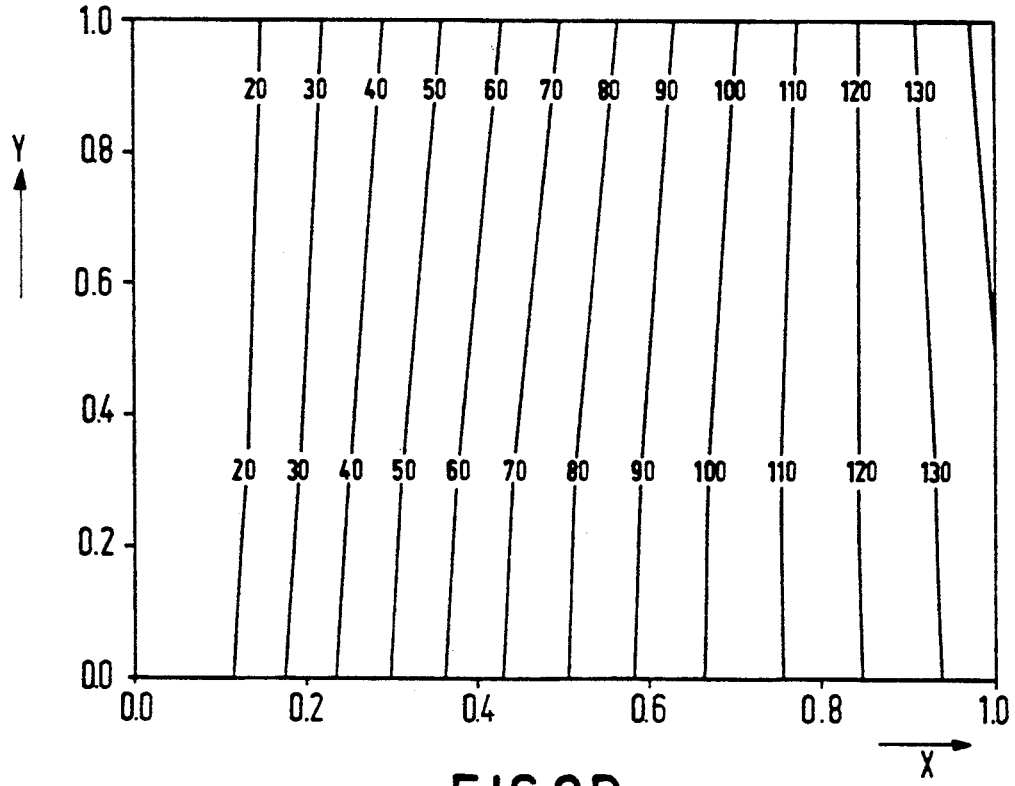

FIGS. 9a and 9b show the effect of the deviations from perfect spherical lines in the y-direction shown in FIGS. 7 and 8. FIG. 9a shows, in the form of lines with equal landing displacements, the effect of local doming as a function of x and y for a color display device the inner surface of the display window of which has "bulge" on the long X axis, the height of the bulge decreasing as y increases and the inner surface along lines in the y-direction extending as perfectly spherical lines; FIG. 9b shows, in the form of lines of equal landing displacement, the effect of local doming in a color display device in which also the inner surface of the display window exhibits a deviation from a perfect sphere along lines in the y-direction, as shown in FIGS. 7 and 8. In both Figures, standardized bean displacements in the x-direction are shown, the beam displacement at the point $x=\frac{2}{3}$, $y=0$ of FIG. 9b being set at 100. The effect of local doming exhibits a marked decrease by providing a "bulge" in the y-direction, the reduction increasing as the x-value increases. For $x=0.7$ and $y=0.9$, the landing displacement caused by local doming is approximately 30% higher in FIG. 9a than in FIG. 9b.

Further, it is noted that in FIG. 9b lines of equal landing displacements extend approximately parallel to the y-axis, whereas lines of equal landing displacement in FIG. 9a clearly describe a curved path. In particular for an in-line color display device, i.e. a color display device having an in-line electron gun, it is advantageous when lines of equal landing displacement extend approximately parallel to the y-axis, i.e. parallel to the axis transverse to the in-line plane. In an in-line color display device, the width of the phosphor strips is approximately constant for a stripe which extends parallel to the y-axis, and the electron spot width is approximately constant. Consequently, a stripe extending parallel to the y-axis has an approximately constant spatial guard band which is determined by the difference between the above-mentioned width dimensions. Preferably, lines of equal landing displacement extend in the same manner as stripes having an equal spatial guard band, i.e. parallel to the y-axis, as shown in FIG. 9b.

As has been noted, the color selection electrode has a shape which is adapted to that of the screen.

It will be obvious that within the scope of the invention many variations are possible to those skilled in the art.

We claim:

1. A cathode ray tube comprising: an envelope including a substantially rectangular curved display window, the window having a center, orthogonally related long and short axes intersecting at the center, a cone and a neck; an electron gun in the neck; a display screen on an inner surface of the display window; and a color selection electrode arranged in front of the display screen; characterized in that a distance z between a plane tangential to the display screen at the center of the display screen and a plane parallel thereto through a point on the long axis is approximately represented by:

$$a=[A_1]R_1-([A_1^2]R_1^2-x^2)^{\frac{1}{2}}+f(x)$$

where $R_1$ is the radius of a perfect circle at the center of the display screen, x is the distance between the center of the display screen, x is the distance between the center of the display screen and the point on the long axis, and f(x) is an approximately symmetrical function of x, which function is 0 for x=0 and for the end of the long axis, which is negative at least substantially everywhere between these points, and which has an extreme for 0.5 L<x<0.9 L, where L is the length of the long axis.

2. A cathode ray tube as claimed in claim 1, characterized in that f(x) has an extreme for 0.65 L<x<0.80 L.

3. A cathode ray tube as claimed in claim 1, characterized in that the distance z between a plane tangential to the display screen at the center of the display screen, and a plane parallel thereto, through a point P on a line parallel to th long axis is approximately represented by:

$$Z=z_0+[R_1]R'_1-([R_1^2]R_1'^2-x^2)^{\frac{1}{2}}+f'(x)$$

where $z_0$ is a constant for the given line, $R_1'$ is a radius of a perfect circle parallel to the long axis, x is the distance a perfect circle parallel to the long axis, x is the distance between the point where the given line intersects the short axis and the point P, and f'(x) is an approximately symmetrical function of x, which function is 0 for x=0 and x=L, which is negative at least substantially everywhere between these points, and which has an extreme for 0.5 L<x<0.9, L, with a value of the extreme decreasing as a value of y increases.

4. A cathode ray tube as claimed in claim 3, characterized in that, when viewed from the long axis, a value of the extreme of f'(x) at the extreme edges is less than 1/5th of the value of the extreme of f'(x) on the long axis.

5. A cathode ray tube as claimed in claim 1, characterized in that the value of the extreme of f'(x) on the long axis is less than 2% of the length of the long axis.

6. A cathode ray tube as claimed in claim 5, characterized in that the value of the extreme of f'(x) on the long axis is more than 0.05% of the length of the long axis.

7. A cathode ray tube as claimed in claim 1, characterized in that the distance z between a plane tangential to the display screen at the center of the display screen, and a plane parallel thereto, through a point P on a line parallel to the long axis is approximately represented by:

$$a=a_0'+]R_1]R_1''-([R_1^2]R_1''^2-y^2)^{\frac{1}{2}}+f''(y)$$

where $z_0$ is a constant for the given line, $R_1''$ is a radius of a perfect circle parallel to the short axis, y is the distance between the point where the given line intersects the long axis and the point P, and f''(y) is an approximately symmetrical function of y, which function is 0 for y=0 and y=$L_1$, which is negative at least substantially everywhere between these points, and which has an extreme for 0.5 $L_1$<x<0.9, $L_1$, where $L_1$ is the length of the short axis and the value of the extreme is dependent on the distance x between the said line and the short axis and increases as the value of x increases.

8. A cathode ray tube as claimed in claim 7, characterized in that a maximum value of the extreme of f''(y) is smaller than 2% of the length of the short axis.

9. A cathode ray tube as claimed in claim 1, characterized in that a radius of curvature of the display window is smaller along the short axis than along the long axis.

10. A cathode ray tube as claimed in claim 1, characterized in that the ratio between a lenghts of the short axis and the long axis is less than 3:4.

11. A color display device comprising a cathode ray tube as claimed in claim 1.

12. A cathode ray tube as claimed in claim 2, characterized in that the distance z between a plane tangential to the display screen at the center of the display screen, and a plane parallel thereto, through a point p on a line parallel to the long axis is approximately represented by:

$$z=z_0+[R_1]R_1^2]R_1'^2-x^2)^{\frac{1}{2}}+f'(x)$$

where $z_0$ is a constant for the given line, $R_1'$ is a radius of a perfect circle parallel to the long axis, x is the distance between the point where the given line intersects the short axis and the point P, and f'(x) is an approximately symmetrical function of x, which functions if 0 for x=0 and x=L, which is negative at least substantially everywhere between these points, and which has an extreme for 0.5 L<x<0.9 L, with a value of the extreme decreasing as the value of y increases.

13. A cathode ray tube as claimed in claim 2, characterized in that a value of the extreme of f'(x) on the long axis is less than 2% of the length of the long axis.

14. A cathode ray tube as claimed in claim 3, characterized in that a value of the extreme of f'(x) on the long axis is less than 2% of the length of the long axis.

15. A cathode ray tube as claimed in claim 4, characterized in that a value of extreme of f'(x) on the long axis is less than 2% of the length of the long axis.

16. A cathode ray tube as claimed in claim 2, characterized in that the distance z between a plane tangential to the display screen at the center of the display screen, and a plane parallel thereto through a point P on a line parallel to the short axis is approximately represented by:

$$z=z'_0+[R_1]R_1''-([R_1^2]R_1''^2-y^2)^{\frac{1}{2}}+f''(y)$$

where $z'_0$ is a constant for the given line, $R_1''$ is a radius of a perfect circle parallel to the short axis, y is the distance between the point where the given line intersects the long axis and the point P, and f''(y) is an approximately symmetrical function of y, which function is 0 for y=0 and y=$L_1$, which is negative at least substantially everywhere between these points, and which has an extreme for 0.5 $L_1$<x<0.9 $L_1$, where $L_1$ is the length of the short axis and the value of the extreme is dependent on the distance x between said given line and the short axis and increases as a value of x increases.

17. A cathode ray tube as claimed in claim 3, characterized in that the distance z between a plane tangential to the display screen at the center of the display screen, and a plane parallel thereto through a point P on a line parallel to the short axis is approximately represented by:

$$a=a'_0+[R_1]R_1''-(R_1^2]R_1''^2-y^2)^{\frac{1}{2}}+f'(y)$$

where $z'_0$ is a constant for the given line, $R_1''$ is a radius of a perfect circle parallel to the short axis, y is the distance between the point where the given line intersects the long axis and the point P, and f''(y) is an approximately symmetrical function of y, which function is 0 for y=0 and $y=L_1$, which is negative at least substantially everywhere between these points, and which has an extreme for $0.5\ L_1<x<0.9\ L_1$, where $L_1$ is the length of the short axis, and the value of the extreme is dependent on the distance x between said given line and the short axis and increases as a value of x increases.

18. A cathode ray tube as claimed in claim 4, characterized in that the distance z between a plane tangential to the display screen at the center of the display screen, and a plane parallel thereto through a point P on a line parallel to the short axis is approximately represented by:

$$z=z'_0+[R_2]R''_1-([R_1^2]R_1''^2-y^2)^{\frac{1}{2}}+f'(y)$$

where $z'_0$ is a constant for the given line, where $R_1''$ is a radius a perfect circle parallel to the short axis, y is the distance between the point where the given line intersects the long axis and the point P, and f''(y) is an approximately symmetrical function of y, and f''(y) is an approximately symmetrical function of y, which function is 0 for y=0 and $y=L_1$, which is negative at least substantially everywhere between these points, and which has an extreme for $0.5\ L_1<x<0.9\ L_1$, were $L_1$ is the length of the short axis, and the value of the extreme is dependent on the distance x between said given line and the short axis and increases as a value of x increases.

19. A cathode ray tube as claimed in claim 5, characterized in that the distance z between a plane tangential to the display screen at the center of the display screen, and a plane parallel thereto through a point P on a line parallel to the short axis is approximately represented by:

$$z=z'_0+[R_1''-([R_1^2]R_1''^2-y^2)^{\frac{1}{2}}f'(y)$$

where $z'_0$ is a constant for a given line, $R_1''$ is a radius of a perfect circle parallel to the short axis, y is the distance between the point where the given line intersects the long axis and the point P, and f''(y) is an approximately symmetrical function of y, which function is 0 for y=0 and $y=L_1$, which is negative at least substantially everywhere between these points, and which has an extreme for $0.5\ L_1<x<0.9\ L_1$, where $L_1$ is the length of the short axis, and the value of the extreme is dependent on the distance x between said given line and the short axis and increases as a value of x increases.

20. A cathode ray tube as claimed in claim 6, characterized in that the distance z between a plane tangential to the display screen at the center of the display screen, and a plane parallel thereto through a point P on a line parallel to the short axis is approximately represented by:

$$a=z'_0+[R_1]R_1''-([R_1^2]R_1''^2-y^2)^{\frac{1}{2}}+f'(y)$$

where $z'_0$ is a constant for the given line, $R_1''$ is a radius of a perfect circle parallel to the short axis, y is the distance between the point where the given line intersects the long axis and the point P, and f''(y) is an approximately symmetrical function of y, which function is 0 for y=0 and $y=L_1$, which is negative at least substantially everywhere between these points, and which has an extreme for $0.5\ L_1,\ <x<0.9\ L_1$, where $L_1$ is the length of the short axis, and the value of the extreme is dependent on the distance x between said given line and the short axis and increases as a value of x increases.

21. A cathode ray tube as claimed in claim 2, characterized in that a radius of curvature of the display window is smaller along the short axis than along the long axis.

22. A cathode ray tube as claimed in claim 3, characterized in that a radius of curvature of the display window is smaller along the short axis than along the long axis.

23. A cathode ray tube as claimed in claim 4, characterized in that a radius of curvature of the display window is smaller along the short axis than along the long axis.

24. A cathode ray tube as claimed in claim 5, characterized in that a radius of curvature of the display window is smaller along the short axis than along the long axis.

25. A cathode ray tube as claimed in claim 6, characterized in that a radius of curvature of the display window is smaller along the short axis than along the long axis.

26. A cathode ray tube as claimed in claim 7, characterized in that a radius of curvature of the display window is smaller along the short axis than along the long axis.

27. A cathode ray tube as claimed in claim 8, characterized in that a radius of curvature of the display window is smaller along the short axis than along the long axis.

28. A cathode ray tube as claimed in claim 2, characterized in that a ratio between lenghts of the short axis and the long axis is less than 3:45.

29. A cathode ray tube as claimed in claim 3, characterized in that a ratio between lenghts of the short axis and the long axis is less than 3:4.

30. A cathode ray tube as claimed in claim 4, characterized in that a ratio between lenghts of the short axis and the long axis is less than 3:4.

31. A cathode ray tube as claimed in claim 5, characterized in that a ratio between lenghts of the short axis and the long axis is less than 3:4.

32. A cathode ray tube as claimed in claim 6, characterized in that a ratio between lenghts of the short axis and the long axis is less than 3:4.

33. A cathode ray tube as claimed in claim 7, characterized in that a ratio between lenghts of the short axis and the long axis is less than 3:4.

34. A cathode ray tube as claimed in claim 8, characterized in that a ratio between lenghts of the short axis and the long axis is less than 3:4.

35. A cathode ray tube as claimed in claim 9, characterized in that a ratio between lenghts of the short axis and the long axis is less than 3:4.

* * * * *